US009847202B2

(12) United States Patent
Kim et al.

(10) Patent No.: US 9,847,202 B2
(45) Date of Patent: Dec. 19, 2017

(54) SMD MICRO MIXED FUSE HAVING THERMAL FUSE FUNCTION AND METHOD FOR MANUFACTURING THE SAME

(71) Applicant: SM HI-TECH CO.,LTD., Ulsan (KR)

(72) Inventors: Hyeon Cheol Kim, Ulsan (KR); Jong Sik Kim, Ulsan (KR)

(73) Assignee: SM HI-TECH CO., LTD., Ulsan (KR)

( * ) Notice: Subject to any disclaimer, the term of this patent is extended or adjusted under 35 U.S.C. 154(b) by 0 days.

(21) Appl. No.: 15/028,309

(22) PCT Filed: Oct. 1, 2015

(86) PCT No.: PCT/KR2015/010367

§ 371 (c)(1),
(2) Date: Apr. 8, 2016

(87) PCT Pub. No.: WO2016/064105

PCT Pub. Date: Apr. 28, 2016

(65) Prior Publication Data

US 2017/0229272 A1 Aug. 10, 2017

(30) Foreign Application Priority Data

Oct. 23, 2014 (KR) ..... 10-2014-0143953

(51) Int. Cl.
*H01H 85/165* (2006.01)
*H01H 85/02* (2006.01)
(Continued)

(52) U.S. Cl.
CPC ..... *H01H 85/0241* (2013.01); *H01C 7/10* (2013.01); *H01H 37/32* (2013.01); *H01H 37/34* (2013.01);
(Continued)

(58) Field of Classification Search
CPC .... H01H 85/0241; H01H 37/74; H01H 69/02; H01H 37/32; H01H 85/165; H01H 37/34; H01C 7/10
(Continued)

(56) References Cited

U.S. PATENT DOCUMENTS 4,780,598 A * 10/1988 Fahey ..... H01C 7/027 219/491
5,276,422 A * 1/1994 Ikeda ..... H01H 77/04 337/16
(Continued)

FOREIGN PATENT DOCUMENTS

JP 10134695 A 5/1998
JP 4036932 B2 1/2008
(Continued)

OTHER PUBLICATIONS

International Search Report for International Application No. PCT/KR2015/010367 dated Jan. 14, 2016.
(Continued)

*Primary Examiner* — Anatoly Vortman
(74) *Attorney, Agent, or Firm* — Cantor Colburn LLP

(57) ABSTRACT

Disclosed is an SMD micro mixed fuse with a thermal fuse function that stably operates at high voltage surges and can interrupt electrical current at a predetermined temperature. The SMD micro mixed fuse includes: a fuse substrate provided with a first electrode and a second electrode; a variator layer formed on a front surface of the fuse substrate; a first contact terminal and a second contact terminal respectively arranged at a first side and a second side of a front surface of the varistor layer and respectively connected to the first electrode and the second electrode; at least one thermal fuse that is arranged on the front surface of the variator layer, is not connected to the first and second contact terminals, but is connected to the fuse substrate; and a
(Continued)

fusible element that is wire-bonded to the first and second contact terminals and is not connected to the thermal fuse.

14 Claims, 6 Drawing Sheets

(51) Int. Cl.
*H01H 37/34* (2006.01)
*H01C 7/10* (2006.01)
*H01H 37/32* (2006.01)
*H01H 69/02* (2006.01)
*H01H 37/74* (2006.01)

(52) U.S. Cl.
CPC ..... *H01H 37/74* (2013.01); *H01H 69/02* (2013.01); *H01H 85/165* (2013.01)

(58) Field of Classification Search
USPC ..... 337/1
See application file for complete search history.

(56) References Cited

U.S. PATENT DOCUMENTS 5,438,473 A * 8/1995 Allina ..... H01C 7/102 361/118
5,444,593 A * 8/1995 Allina ..... H01C 7/10 361/111
5,712,610 A * 1/1998 Takeichi ..... H01H 85/046 29/623
5,777,540 A * 7/1998 Dedert ..... H01H 85/143 257/665
5,790,359 A * 8/1998 Kapp ..... H02H 9/042 337/28
5,939,968 A * 8/1999 Nguyen ..... H01C 1/1406 337/12
6,023,028 A * 2/2000 Neuhalfen ..... H01C 7/006 174/250
6,300,859 B1 * 10/2001 Myong ..... H01C 1/1406 337/14
6,452,475 B1 * 9/2002 Kawazu ..... H01H 85/463 29/623
6,922,131 B2 * 7/2005 Walsh ..... H01C 1/016 337/159
7,050,284 B2 * 5/2006 Anthony ..... H01G 4/012 361/118
7,088,216 B2 * 8/2006 Furuuchi ..... H01H 37/76 337/182
7,286,037 B2 * 10/2007 Furuuchi ..... H01H 85/046 337/159
7,554,432 B2 * 6/2009 Graf ..... H01C 7/126 337/159
8,547,195 B2 * 10/2013 Kimura ..... H01H 37/761 29/623
8,803,652 B2 * 8/2014 Kimura ..... H01H 37/761 29/623

FOREIGN PATENT DOCUMENTS

JP 2013197447 A 9/2013
KR 100303962 B1 11/2001
KR 101409827 B1 6/2014

OTHER PUBLICATIONS

Written Opinion for International Application No. PCT/KR2015/010367 dated Jan. 14, 2016.

* cited by examiner

SMD MICRO MIXED FUSE HAVING THERMAL FUSE FUNCTION AND METHOD FOR MANUFACTURING THE SAME

TECHNICAL FIELD

The present invention relates to an SMD micro mixed fuse and, more particularly, to an SMD micro mixed fuse with a thermal fuse function that stably operates at high voltage surges and has a mixed structure including a heating electrode, a temperature, and a varistor to interrupt electrical current when heated to a specific temperature due to heat generated during operation of a micro fuse. Additionally, the present invention relates to a method for manufacturing the SMD micro mixed fuse with a thermal fuse function.

BACKGROUND ART

A micro fuse is a device to protect electronic elements by interrupting excessive electrical current in an electronic circuit. It is an essential component in an electronic device such as a mobile electronic device or a charger. With increasing use of mobile electronic devices and chargers therefor, surface mount device (SMD)-type micro fuses that can stably operate at high surges have been developed and used.

Categories of micro fuses include fast-acting fuses for overcurrent and time-lag fuses for inrush current or high surges.

A time-lag micro fuse is designed such that the length of a fuse wire (fusible element) is longer than that in a normal fuse. Korean Patent No. 10-1058946, which is issued to the present assignee and titled "Time-lag Micro Fuse with Multilayered Molding Layer and Method for Manufacturing the Same", suggests a micro fuse including a fuse substrate, a fusible element connected to each terminal formed on the fuse substrate, and a molding layer formed on the entire surface of the fuse substrate to cover the fusible element.

Recently, with development of smart mobile electronic devices such as table computers and mobile telecommunication devices, there is the demand for electricity storage devices having high capacity. Therefore, there is a trend wherein high-capacity secondary batteries such as Li-ion and Li-polymer batteries are being developed. Along with such trends, there is also demand for development of a fuse having a thermal fuse function due to risk of fire or explosion during battery charging or discharging at high temperatures, in addition to the usual current fuse function that deals with overcurrent higher than rated current.

DISCLOSURE

Technical Problem

Accordingly, the present invention has been made keeping in mind the above problems occurring in the prior art, and an object of the present invention is to provide a technology for reducing risk of fire or explosion attributable to overcurrent or to battery charging or discharging at high temperatures. Specifically, the present invention provides an SMD micro mixed fuse designed to stably operate at high voltage surges and to have a mixed structure including a heating electrode, a temperature fuse, and a varistor, and a method for manufacturing the same. The SMD micro mixed fuse according to the present invention has a thermal fuse function to interrupt electrical current according to heat generated during operation of a fuse.

Technical Solution

In order to accomplish the above objects, according to one aspect, there is provided an SMD micro mixed fuse with a thermal fuse function, including: a fuse substrate provided with at least one first electrode and at least one second electrode; a varistor layer formed on a front surface of the fuse substrate; a first contact terminal and a second contact terminal arranged on a front surface of the varistor layer, respectively at a first side and a second side of the varistor layer, and respectively connected to the at least one first electrode and the at least one second electrode; at least one thermal fuse that is not connected to the first and second contact terminals, is arranged on the front surface of the varistor layer, and is connected to the fuse substrate; and a fusible element that is not connected to the at least one thermal fuse but is wire-bonded to the first and second contact terminals.

In order to accomplish the above objects, according to another aspect, there is provided a method for manufacturing an SMD micro mixed fuse with a thermal fuse function, the method including: forming at least one first electrode and at least one second electrode on at least one fuse substrate; forming a varistor layer on a front surface of the fuse substrate; forming a first contact terminal and a second contact terminal that are arranged respectively at a first side and a second side of a front surface of the varistor layer and are respectively connected to the first electrode and the second electrode; forming a thermal fuse that is not connected to the first and second contact terminals, is arranged on the front surface of the varistor layer, and is connected to the fuse substrate; and forming a fusible element that is not connected to the thermal fuse but is wire-bonded to the first and second contact terminals.

Advantageous Effects

According to the present invention that relates to an SMD micro mixed fuse with a thermal fuse function and method for manufacturing the same, it is possible to enable stable operation of a micro fuse at high voltage surges, thereby prolonging the lifetime of a micro fuse and protecting an electronic circuit from abnormal current.

In addition, since the SMD micro mixed fuse according to the present invention has a structure in which a heating electrode, a thermistor thermal fuse, and a varistor are added to a micro fuse, the SMD micro mixed fuse can interrupt electrical current when heated to a specified temperature under occurrence of overcurrent. Accordingly, the SMD micro mixed fuse according to the present invention is immune to temperature changes, thereby stably operating at high temperatures.

Especially, the varistor made of a suitable material eliminates transient waveforms of irregular voltages or currents, thereby contributing to stable operation and increased lifetime of a micro fuse, which improves operation reliability of a micro fuse.

MODE FOR INVENTION

Reference will now be made in detail to various embodiments of the present invention, specific examples of which are illustrated in the accompanying drawings and described below, since the embodiments of the present invention can be variously modified in many different forms. While the present invention will be described in conjunction with exemplary embodiments thereof, it is to be understood that the present description is not intended to limit the present invention to those exemplary embodiments. On the contrary, the present invention is intended to cover not only the exemplary embodiments, but also various alternatives, modifications, equivalents and other embodiments that may be included within the spirit and scope of the present invention as defined by the appended claims.

The terminology used herein is for the purpose of describing particular embodiments only and is not intended to be limiting. As used herein, the singular forms "a", "an" and "the" are intended to include the plural forms as well, unless the context clearly indicates otherwise.

Hereinafter, embodiments of the present invention will be described in detail with reference to the accompanying drawings.

Figure 1:
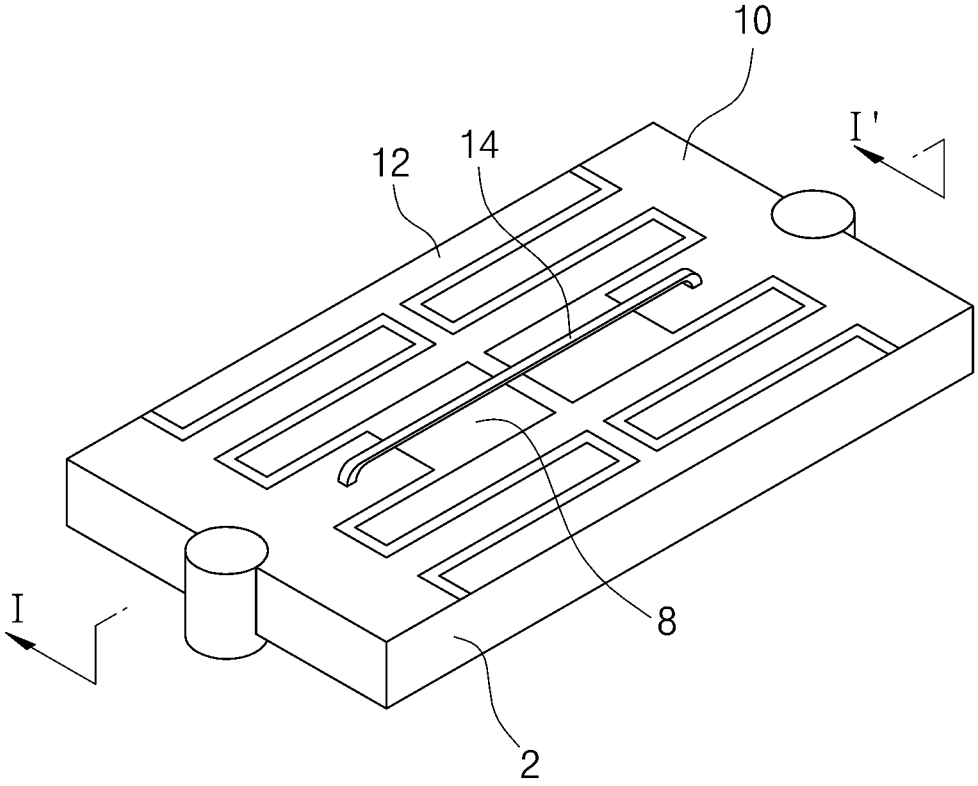
FIG. 1 is a perspective view illustrating an SMD micro mixed fuse with a thermal fuse function, according to one embodiment of the present invention.
Figure 2:
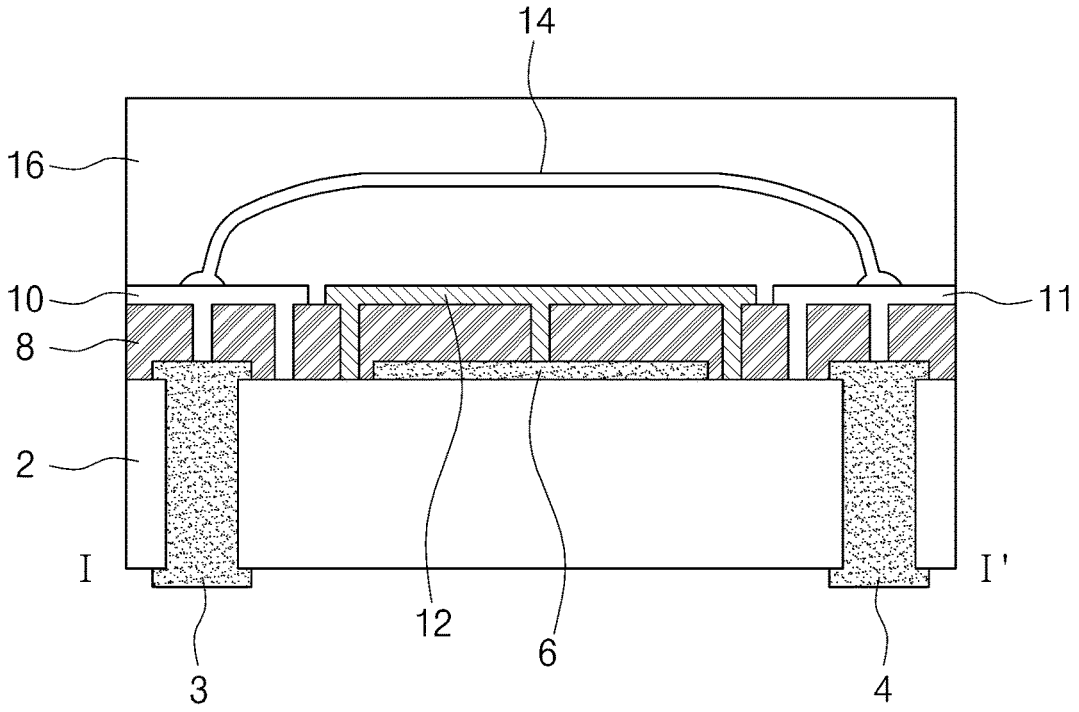
FIG. 2 is a cross-sectional view taken along line I-I' of FIG. 1.
Figure 3:
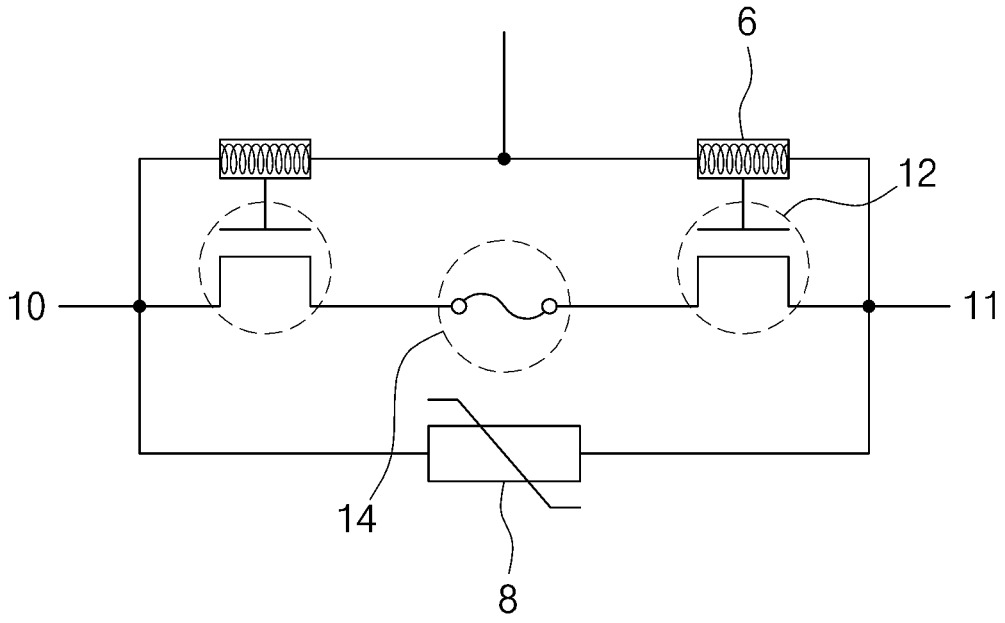
FIG. 3 is a circuitry diagram illustrating the SMD micro mixed fuse with a thermal fuse function, according to the embodiment of the present invention.

FIG. 1 is a perspective view illustrating an SMD micro mixed fuse with a thermal fuse function, according to one embodiment of the present invention; and FIG. 2 is a cross-sectional view taken along line I-I' of FIG. 1. FIG. 3 is a circuitry diagram illustrating the SMD micro mixed fuse with a thermal fuse function, according to the embodiment of the present invention.

The SMD micro mixed fuse with a thermal fuse function illustrated in FIGS. 1 to 3 includes: a fuse substrate 2 provided with at least one first electrode 3 and at least second electrode 4; a varistor layer 8 formed over a front surface of the fuse substrate 2; a first contact terminal 10 and a second contact terminal 11 that are arranged on a front surface of the varistor layer 8 respectively at a first side and a second side of the fuse substrate 2 and that are respectively connected to the at least one first electrode 3 and the at least one second substrate 4; at least one thermal fuse 12 that is arranged on the front surface of the varistor layer 8 without being connected to the first or second contact terminals 10, 11 and that is connected to the fuse substrate 2 through a plurality of contact holes that extends through the variator layer 8; and a fusible element 14 that is wire-bonded to the first and second connection terminals 10 and 11, without being connected to the at least one thermal fuse 12.

In addition, the SMD micro mixed fuse with a thermal fuse function may further include: at least one heating electrode 6 that is provided between the front surface of the fuse substrate 2 and a rear surface of the varistor layer 8, without being connected to the at least one first electrode 3 and the at least one second electrode 4; and a molding layer 16 that entirely covers the fuse substrate 2 so that the first and second contact terminals 10 and 11, the fusible element 14, and the at least one thermal fuse 12 are covered by the molding layer 16. The at least one thermal fuse 12 may be electrically connected to the at least one heating electrode 6 through any one of the plurality of contact holes that extends through the varistor layer 8.

The fuse substrate 2 may be made a FR4 PCB having high thermal resistance. The fuse substrate 2 is provided with at least one first electrode 3 and at least one second electrode 4 at respective opposing sides (first side and second side opposite to each other) of the fuse substrate 2. The first and second electrodes 3 and 4 can be connected to external terminals.

The at least one first electrode 3 and the at least one second electrode 4 are attached to or provided to surround some portions of the first and second sides of the fuse substrate 2. Alternatively, they may be formed as plugs provided in through holes formed in the fuse substrate 2 of FIG. 2.

The varistor layer 8 covers the entire area of a front surface of the fuse substrate 2 as well as the first and second electrodes 3 and 4. The varistor layer 8 allows passage of current therethrough only at a specified voltage or higher according to the composition thereof, thereby interrupting a specified voltage surge. Accordingly, the varistor layer 8 can protect against a specified voltage surge. In other words, when current surges so that a high voltage is applied to the varistor layer 8, the resistance value of the variator layer 8 decreases to allow passage of high electrical current, thereby interrupting a specified surge voltage. Accordingly, the varistor layer 8 can protect an electronic circuit from a surge voltage. The varistor layer 8 may be made of a SiC-based or ZnO-based material. Alternatively, the varistor layer 8 may be made of a mixed material including SiC or Zno as a main substance and conductive silicon, carbon complex, or oxide as an auxiliary substance. Specifically, it is possible to control conduction of electrical current of a specified level according to a composition ratio of the content of metal oxide (or ceramic) with respect to the content of SiC or ZnO or a dimension ratio (for example, 3:1 (60 μm:20 μm)). The varistor layer 8 made of a material having an optimal composition ratio or structure eliminates excessive transient waveforms of irregular voltages or currents, thereby contributing to stable operation or increased lifetime of a micro fuse. When the varistor layer 8 is formed to cover the entire front surface of the fuse substrate 2 as well as the first and second electrodes 3 and 4, the contact area and volume can be increased, which increases stability in operation of a micro fuse.

The first and second contact terminals 10 and 11 are arranged at portions of the front surface of the varistor layer 8, which are near the first and second sides of the varistor layer 8, respectively. The first and second contact terminals 10 and 11 are electrically connected to the at least one first electrode 3 and the at least one second electrodes 4, respectively. Specifically, the first and second contact terminals 10 and 11 are made of copper (Cu), aluminum (Al), silver (Ag), gold (Au), or an alloy of copper and aluminum through a patterning process. The first and second contact terminals 10 and 11 are arranged at portions of the front surface of the varistor layer 8, which are near the first and second sides of the varistor layer 8, respectively. In addition, the first and second contact terminals 10 and 11 are electrically connected to the at least one first electrode 3 and the at least one second electrode 4, respectively and to the fuse substrate 2 through contact holes formed in the varistor layer 8.

The at least one thermal fuse 12 is arranged on the front surface of the varistor layer 8 and is not connected to the first and second contact terminals 10 and 11. The at least one thermal fuse 12 is connected to the fuse substrate 2 through at least any one of the plurality of contact holes formed in the varistor layer 8. Since the at least one thermal fuse 12 is in contact with and fixed to the varistor layer 8 through any one of the plurality of contact holes, heat conductivity and current control efficiency can be increased.

The thermal fuse 12 is fabricated made by sintering a metal oxide. The thermal fuse 12 has electrical characteristics in which its electrical resistance is variable. The thermal fuse 12 may be a binary system or a ternary system so that it is formed by mixing powder of two or three transition metal oxides of manganese (Mn), nickel (Ni), cobalt (Co), iron (Fe), and copper (Co).

As illustrated in FIGS. 2 and 3, the at least one thermal fuse 12 may include at least one heating electrode 6. The at least one heating electrode 6 is formed on a portion of the front surface of the fuse substrate 2 and is not connected to the first and second electrodes 3 and 4. The varistor layer 8 is arranged to cover the heating electrode 6 and is formed through deposition and curing processes. The at least one thermal fuse 12 is patterned to be electrically connected to the at least one heating electrode 6 through at least one of the plurality of contact holes that extends through the varistor layer 8. Since the at least one thermal fuse 12, the varistor layer 8, and the heating electrode 6 are connected and fixed to each other through the at least one contact hole, heat conductivity, which depends on a contact area between elements, and control efficiency for current conduction can be increased.

The at least one heating electrode 6 is heated by heat generated during operation of a micro fuse. When the heating element 6 is heated, its resistance, volume, and coefficient of thermal expansion change. The thermal fuse 12 that is directly connected to the at least one heating electrode 6 and the varistor layer 8 controls current conduction according to the heating degree of the heating electrode 6.

The at least one fusible element 14 is not connected to the at least thermal fuse 12 but is electrically connected to the first and second contact terminals 10 and 11 through a wire bonding method. The at least one fusible element 14 is made of a material that has similar electrical conductivity to the first and second contact terminals 10 and 11. The at least one fusible element 14 is formed to be connected to the first and second contact terminals 10 and 11 through a ball wire bonding method and made of a metal selected from the group consisting of silver, copper, gold, aluminum, and alloys thereof, or of a material plated with any of those metals. The at least one fusible element 14 is used to connect independent patterns to each other and also functions as a fusible body that can safely protect a circuit from abnormal inrush current.

In other words, since the at least one fusible element 14, the at least one thermal fuse 12 including the at least one heating electrode 6, and the varistor layer 8 are in contact with and are fixed to each other through at least one contact hole, heat conduction efficiency and current conduction control efficiency that depend on the contact area can be increased.

The molding layer 16 covers the entire surface of the fuse substrate 2 as well as the first and second contact terminals 10 and 11, the fusible element 14, and the at least one thermal fuse 12. The molding layer 16 is formed by coating photoimageable solder resist mask (PSR) ink on the surface of the fuse substrate 2 to be a predetermined thickness in order to prevent the fusible element 14 from being contaminated by impurities or to prevent the fusible element 14 from being damaged by external impact. In this case, it is preferable that the molding layer 16 surrounds the fusible element 14 for protection and safety for the fusible element 14. The PSR ink is preferably coated through a screen printing method. That is, a printing mask (not shown) having an opening that corresponds to the fuse substrate 2 is first prepared. Next, PSR ink is applied to the printing mask so that the PSR ink can be coated on the fuse substrate through the opening. In this way, a predetermined thickness of PSR ink is coated on the fuse substrate 2 and then cured. As a result, the molding layer 16 is formed.

Figure 4:
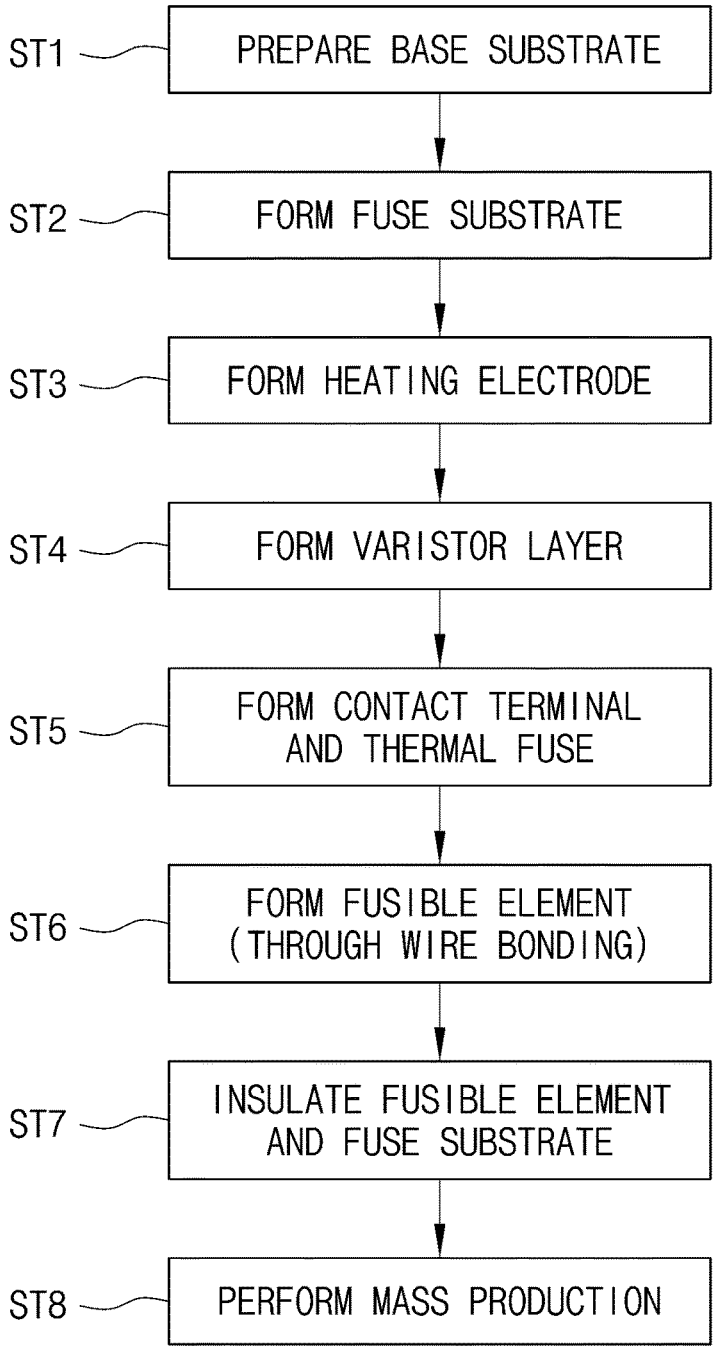
FIG. 4 is a flowchart showing a method of manufacturing an SMD micro mixed fuse with a thermal fuse function, according to another embodiment of the present invention.

FIG. 4 is a flowchart illustrating a method for manufacturing an SMD micro mixed fuse with a thermal fuse function.

Figure 5:
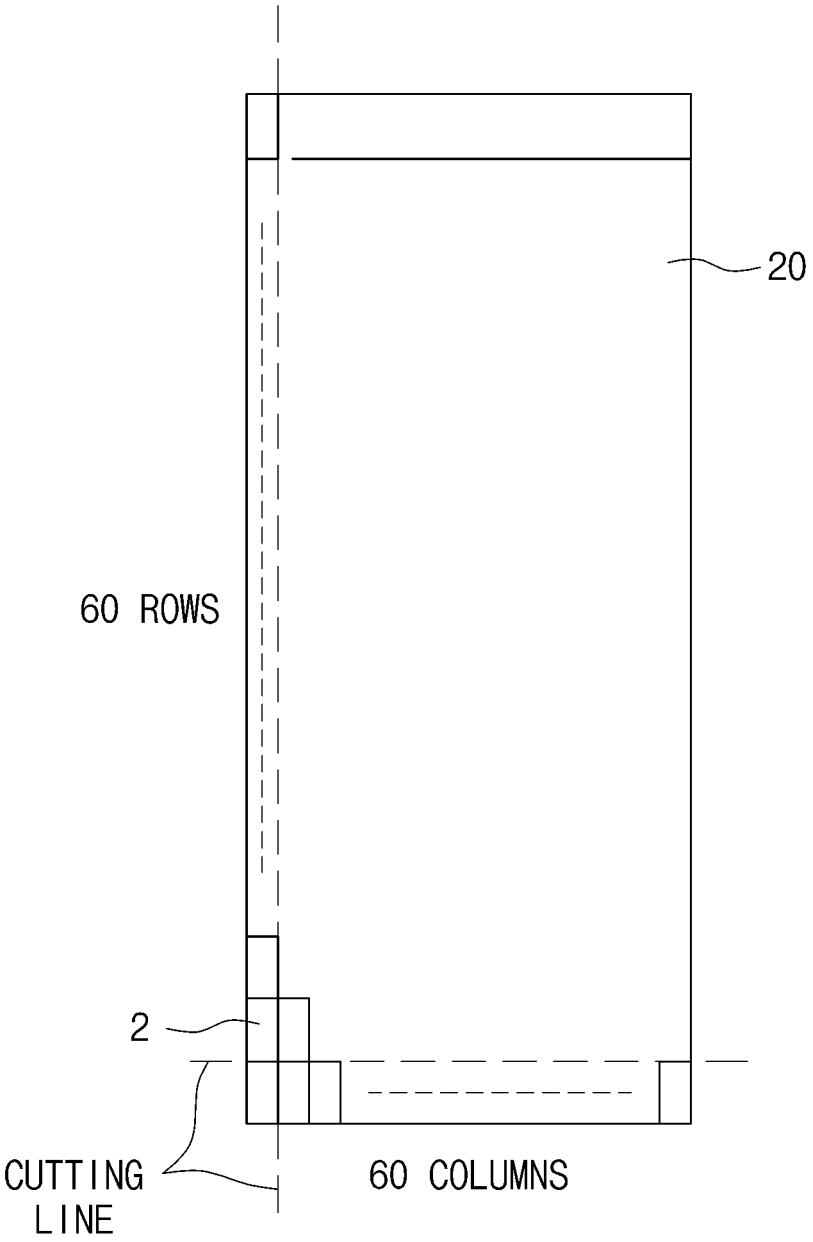
FIG. 5 is a layout of a base substrate used for mass production of SMD micro mixed fuses.

With reference to FIG. 4, at a base substrate preparation step ST1, a base substrate 20 in which a plurality of fuse substrates 2 are defined to be arranged in rows and columns is prepared. With reference to FIG. 5 that illustrates the structure of the base substrate 20, multiple fuse substrates 2 are defined to be arranged at regular intervals in the base substrate 20. For example, 60 rows×60 columns of fuse substrates are defined.

At a fuse substrate formation step ST2, FR4 PCB having high thermal resistance is divided into fuse substrates 2. At least one first electrode 3 and at least one second electrode 4 are formed at portions of first and second sides of each fuse substrate 2, respectively. The at least one first electrode 3 and the at least one second electrode 4 are formed to be attached to or to surround the portions of the first and second sides of the fuse substrate 2. Alternatively, the at least one first electrode 3 and the at least one second electrode 4 may be formed to extend through through-holes in the fuse substrate 2 as illustrated in FIG. 2.

At a heating electrode formation step ST3, at least one heating electrode 6 is patterned on a front surface of each fuse substrate 2. At this point, the heating electrode 6 is formed not to be connected to the first and second electrodes 3 and 4. The at least one heating electrode 6 may be made of the same material as the first and second electrodes 3 and 4, through the same patterning process as the first and second electrodes 3 and 4. That is, the at least one heating electrode, and the first and second electrodes 3 and 4 may be simultaneously formed through a patterning process in which light exposure and etching are sequentially performed using at least one mask.

Figure 6:
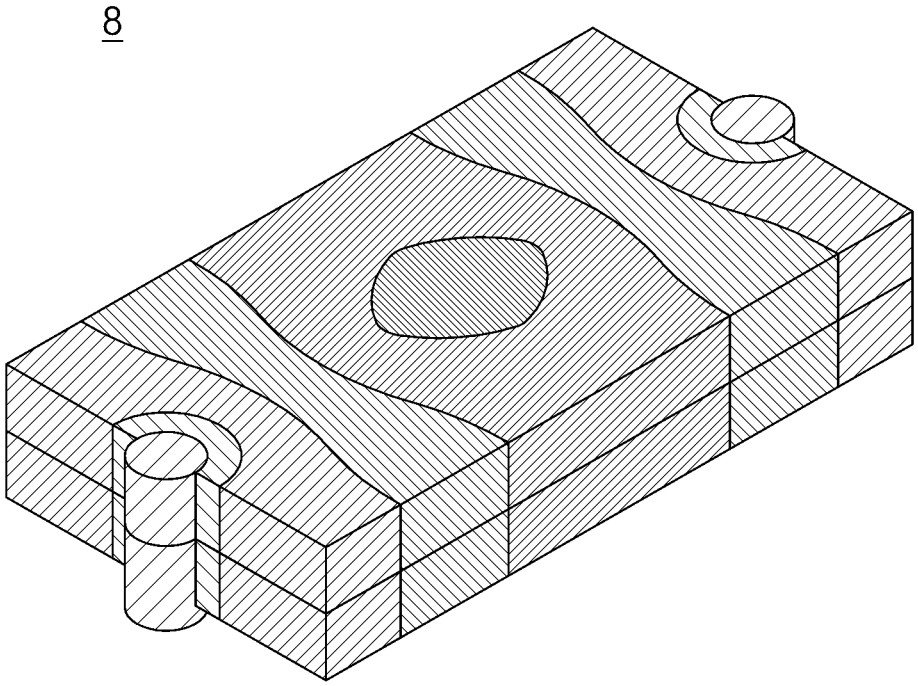
FIG. 6 is a perspective view illustrating a thermal profile of an SMD micro fuse that is obtained via simulation using ANSYS simulation software.

FIG. 6 illustrates 3D modeling of an SMD micro mixed fuse that is a simulation result obtained using ANSYS software. Thermal characteristics at overcurrent show that temperature is higher toward the center of the SMD micro mixed fuse than it is toward the edges. Accordingly, it is preferable that the at least one heating electrode 6 be formed at a center portion of each fuse substrate 2 and not connected to the first and second electrodes 3 and 4.

At a varistor layer formation step ST4, a varistor layer 8 is formed to cover the entire front surface of each fuse substrate 2 as well as the first and second electrodes 3 and 4. The varistor layer 8 is formed by depositing a SiC-based material, a ZnO-based material, or a combination of SiC-based material film and ZnO-based material film, and patterning the deposited film. For example, in each varistor layer 8, a ratio of the SiC-based material to the ZnO-based material may be 3:1 (for example, 60 μm:20 μm). In the patterning process for the varistor layer 8, a plurality of contact holes is also formed.

At a contact terminal and thermal fuse formation method ST5, a first contact terminal 10 and a second contact terminal 11 are formed on a front surface of the varistor layer 8 so as to be connected to the first electrode 3 and the second electrode 4, respectively, through the contact holes. The first and second contact terminals 10 and 11 are formed by depositing and patterning copper (Cu), aluminum (Al), silver (Ag), or gold (Au). Alternatively, the first and second contact terminals 10 and 11 may be formed by depositing and patterning an alloy of those metals. Since the first and second contact terminals 10 and 11 are fixed to the first and second electrodes 3 and 4, and the fuse substrate 2 through the contact holes, current conduction paths are formed and the structure of the varistor layer 8 can be securely fixed.

Next, at least one thermal fuse 12 is formed, through a patterning process, on the front surface of the varistor layer 8. At this point, the thermal fuse 12 is formed not to be connected to the first and second contact terminals 10 and 11. The thermal fuse 12 is formed by sintering a metal oxide. The thermal fuse 12 has electrical characteristics in which its electrical resistance varies according to temperature. The thermal fuse 12 may be a binary metal oxide or a ternary metal oxide. The thermal fuse 12 may be formed by mixing powder of two or three kinds of transition metal oxides of manganese, nickel, cobalt, iron, copper, and so on. The thermal fuse 12 is connected to the fuse substrate 2 through any one of the plurality of contact holes that extends through the varistor layer 8.

At a fusible element formation step ST6, at least one fusible element 14 is formed to be connected the first and second contact terminals 10 and 11 in a wire bonding manner. The fusible element 14 is formed not to be connected to the at least one thermal fuse 12. The fusible element 14 is made of a material that has similar electrical conductivity to the first and second contact terminals 10 and 11 and extends in the same direction as the first and second contact terminals 10 and 11. The fusible element 14 is connected to the first and second contact terminals 10 and 11 through a ball wire bonding method and is made of a metal selected from the group consisting of silver, copper, gold, aluminum, and alloys thereof, or of a material plated with any of those metals.

At an insulation step ST7 for fusible element and fuse substrate, a molding layer 16 is formed to cover the fuse substrate 2 as well as the first and second contact terminals 10 and 11, the fusible element 14, and the at least one thermal fuse 12. The molding layer 16 is formed by coating a predetermined thickness of photoimageable solder resist mask ink (PSR ink) on the fuse substrate 2. It is preferable that the molding layer 16 surrounds the fusible element 14 for protection and safety of the fusible element 14. Coating of the PSR ink is performed through a screen printing process. That is, first, a printing mask (not shown) having an opening that corresponds to the shape of the fuse substrate 2 is prepared. Next, the PSR ink is coated on the fuse substrate 2 through the opening of the printing mask. As a result, the PSR ink is coated on the fuse mask 2 to be the predetermined thickness. Next, the coated PSR ink is cured to form the molding layer 16.

At a mass production step ST8, a plurality of SMD micro mixed fuses formed in one PCB used as a base substrate is cut at regular intervals using a high speed blade. Through this process, the plurality of SMD micro mixed fuses is separated from each other. That is, the SMD micro mixed fuses are mass-produced. With reference to FIG. 5 that illustrates a base substrate and SMD micro mixed fuses, a plurality of SMD micro mixed fuses is arranged at regular intervals in the base substrate.

The SMD micro mixed fuse with a thermal fuse function and the method for manufacturing the same according to the embodiment of the present invention increases the lifetime of a micro fuse by enabling stable operation at high voltage surges and protects an electronic circuit from abnormal current.

In addition, since a heating electrode, a thermistor thermal fuse, and a varistor are incorporated into an SMD micro fuse, electrical current can be interrupted when the SMD micro fuse is heated to a predetermined temperature under occurrence of overcurrent. Therefore, it is possible to provide a micro fuse that safely interrupts electrical current according to temperature changes.

The varistor made of a suitable material eliminates excessive transient waveforms of irregular voltages and currents and contributes to stable operation of a micro fuse. Accordingly, the varistor maximally increases the lifetime of a micro fuse, which results in improvement in operation reliability of an SMD micro fuse.

Although preferred embodiments of the present invention have been described for illustrative purposes, those skilled in the art will appreciate that various modifications, additions and substitutions are possible, without departing from the scope and spirit of the invention as disclosed in the accompanying claims.

INDUSTRIAL APPLICABILITY

According to the described embodiments of the present invention, the SMD micro mixed fuse with a thermal fuse function, which has the various advantages and technical features described above, and the method for manufacturing method for the same increase the lifetime of a micro fuse by enabling stable operation of the micro fuse at high voltage surges and protects an electronic circuit from abnormal current.

In addition, since a heating electrode, a thermistor thermal fuse, and a varistor are incorporated into an SMD micro fuse, electrical current can be interrupted when the SMD micro fuse is heated to a predetermined temperature under occurrence of overcurrent. Therefore, it is possible to provide a micro fuse that safely interrupts electrical current according to temperature changes.

The invention claimed is:

1. An SMD micro mixed fuse with a thermal fuse function, the SMD micro mixed fuse comprising:

a fuse substrate provided with at least one first electrode and at least one second electrode;

a varistor layer formed on a front surface of the fuse substrate;

a first contact terminal and a second contact terminal arranged on a front surface of the varistor layer, respectively at a first side and a second side of the varistor layer, and respectively connected to the at least one first electrode and the at least one second electrode;

at least one thermal fuse that is not connected to the first and second contact terminals, is arranged on the front surface of the varistor layer, and is connected to the fuse substrate; and a fusible element that is not connected to the at least one thermal fuse but is wire-bonded to the first and second contact terminals.

2. The SMD micro mixed fuse with a thermal fuse function, according to claim 1, further comprising:

at least one heating electrode that is not connected to the at least one first electrode and the at least one second electrode and is arranged between the front surface of the fuse substrate and a rear surface of the varistor layer; and a molding layer that covers the entire surface of the fuse substrate as well as the first and second contact terminals, the fusible element, and the at least one thermal fuse.

3. The SMD micro mixed fuse with a thermal fuse function, according to claim 2, wherein the at least one thermal fuse is electrically connected to the at least one heating electrode through any one of a plurality of contact holes formed to extend through the varistor layer, and wherein the at least one thermal fuse is connected to the fuse substrate through another contact hole of the plurality of contact holes.

4. The SMD micro mixed fuse with a thermal fuse function, according to claim 1, wherein the varistor layer is made of a SiC-based material or a ZnO-based material, or made of a material that contains a SiC- or ZnO-based material as a main component and a metal oxide as an auxiliary component, and wherein the varistor layer controls conduction of an electrical current of a predetermined level according to a composition ratio of the metal oxide or ceramic with respect to SiC- or ZnO-based material.

5. The SMD micro mixed fuse with a thermal fuse function, according to claim 1, wherein the first and second contact terminals are arranged at the first and second sides of the varistor layer, and are electrically connected to the first and second electrodes and the fuse substrate through respective contact holes of the plurality of contact holes that are formed to extend through the varistor layer.

6. The SMD micro mixed fuse with a thermal fuse function, according to claim 2, wherein the at least one heating electrode is patterned not to be connected to the first and second electrodes and to be arranged on the front surface of the fuse substrate, wherein the varistor layer is formed to cover the heating electrode through a deposition process and a curing process, and the thermal fuse is patterned to be electrically connected to the at least one heating electrode through at least one contact hole of the plurality of contact holes that extends through the varistor layer.

7. The SMD micro mixed fuse with a thermal fuse function, according to claim 1, wherein the thermal fuse is formed by mixing powder of at least one transition metal oxide of manganese, nickel, cobalt, iron, and copper with powder of other metal oxides according to whether the thermal fuse is a binary system or a ternary system.

8. A method for manufacturing an SMD micro mixed fuse with a thermal fuse function, the method comprising:

forming at least one first electrode and at least one second electrode on at least one fuse substrate;

forming a varistor layer on a front surface of the fuse substrate;

forming a first contact terminal and a second contact terminal that are arranged respectively at a first side and a second side of a front surface of the varistor layer and are respectively connected to the first electrode and the second electrode;

forming a thermal fuse that is not connected to the first and second contact terminals, is arranged on the front surface of the varistor layer, and is connected to the fuse substrate; and forming a fusible element that is not connected to the thermal fuse but is wire-bonded to the first and second contact terminals.

9. The method according to claim 8, further comprising:

forming at least one heating electrode that is not connected to the first and second electrodes and is arranged between the front surface of the fuse substrate and a rear substrate of the varistor layer; and forming a molding layer that covers the entire surface of the fuse substrate as well as the first and second contact terminals, the fusible element, and the at least one thermal fuse.

10. The method according to claim 9, wherein the forming of the at least one thermal fuse is performed such that the thermal fuse is patterned to be electrically connected to the at least one heating electrode through at least one of a plurality of contact holes that are through-holes formed in the varistor layer, and wherein the thermal fuse is patterned to be connected to the fuse substrate through another contact hole of the plurality of contact holes formed in the varistor layer.

11. The method according to claim 8, wherein the forming of the varistor layer is performed by depositing and patterning a SiC-based or ZnO-based material or depositing and patterning a metal oxide mixture containing a SiC-based or ZnO-based material as a main component, wherein the variator layer controls conduction of electrical current of a predetermined level that is determined according to a composition ratio of a metal oxide or ceramic with respect to the SiC-based or ZnO-based material.

12. The method according to claim 8, wherein the forming of the first and second contact terminals is performed such that the first and second contact terminals are patterned to be arranged at the first and second sides of the front surface of the varistor layer and to be connected to the at least one first electrode and the at least one second electrode and to the fuse substrate through respective contact holes of the plurality of contact holes formed in the varistor layer.

13. The method according to claim 9, wherein the at least one heating element is patterned to be arranged on the front surface of the fuse substrate and not to be connected to the first and second electrodes, wherein the varistor layer is deposited and patterned to cover the heating electrode; and wherein the thermal fuse is patterned to be electrically connected to the at least one heating electrode through at least one contact hole of the plurality of contact holes formed in the varistor layer.

14. The method according to claim 8, wherein the forming of the thermal fuse is performed by mixing powder of a transition metal oxide based on any one metal selected from the group consisting of manganese, nickel, cobalt, iron, and copper, with powder of another or other metal oxide according to whether the thermal fuse is a binary system or a ternary system.

* * * * *